US005878520A

United States Patent [19]

Milbrandt et al.

[11] Patent Number: 5,878,520

[45] Date of Patent: Mar. 9, 1999

[54] ADJUSTABLE ADVERTISING BAND

[75] Inventors: Jay A. Milbrandt, Sioux Falls, S. Dak.; Debra K. Houseman, Fulda, Minn.; John B. Linquist, Sibley, Iowa

[73] Assignee: Bedford Industries, Worthington, Minn.

[21] Appl. No.: 9,701

[22] Filed: Jan. 20, 1998

[51] Int. Cl.[6] ..... G09F 03/14

[52] U.S. Cl. ..... 40/665; 24/16 PB

[58] Field of Search ..... 24/16 PB, 30.5 P, 24/17 AP; 40/665

[56] References Cited

U.S. PATENT DOCUMENTS

| | | | |
|---|---|---|---|
| 1,945,932 | 2/1934 | Caley . | |
| 2,961,785 | 11/1960 | Toepfer . | |
| 3,072,986 | 1/1963 | Lefnaer | 24/30.5 X |
| 3,130,462 | 4/1964 | Mitchell . | |
| 3,224,054 | 12/1965 | Lige . | |
| 3,255,501 | 6/1966 | Laguerre . | |
| 3,365,753 | 1/1968 | Prenner et al. . | |
| 3,548,463 | 12/1970 | Kohke . | |
| 3,874,034 | 4/1975 | Clayton | 24/30.5 |
| 3,913,178 | 10/1975 | Ballin et al. | 24/30.5 X |
| 3,973,610 | 8/1976 | Ballin | 24/30.5 X |
| 4,142,310 | 3/1979 | Groselak et al. . | |
| 4,198,772 | 4/1980 | Furutu | 40/665 |
| 4,403,375 | 9/1983 | Blum | 24/16 PB |
| 4,466,159 | 8/1984 | Burrage | 24/16 PB |
| 4,477,950 | 10/1984 | Cisek et al. | 24/30.5 |
| 4,588,218 | 5/1986 | Guiler et al. | 24/16 PB X |
| 4,942,644 | 7/1990 | Rowley | 24/30.5 X |
| 5,189,761 | 3/1993 | Chisholm | 24/16 PB |
| 5,402,971 | 4/1995 | Bower . | |
| 5,669,111 | 9/1997 | Rohaly | 24/17 AP X |

FOREIGN PATENT DOCUMENTS

| | | | |
|---|---|---|---|
| 123192 | 6/1931 | Austria | 40/665 |
| 692631 | 8/1964 | Canada . | |
| 1309873 | 10/1962 | France . | |
| 1319446 | 1/1963 | France . | |
| 209245 | 5/1960 | Germany . | |
| 360840 | 4/1962 | Switzerland . | |
| 903599 | 8/1962 | United Kingdom . | |
| 1033541 | 6/1966 | United Kingdom . | |
| 1097213 | 1/1968 | United Kingdom . | |

*Primary Examiner*—Joanne Silbermann
*Attorney, Agent, or Firm*—R. C. Baker & Associates, Ltd.

[57] ABSTRACT

The new advertising band for quick and easy locking, unlocking and re-locking about merchandise is a flexible strip having a lead end section, a body section, and a tail end section. The lead end section is equipped with a lock aperture having a maximum dimension in the longitudinal direction and a minimum dimension transverse thereto. The body section has a substantial length and transverse width for displaying advertising information. Its length is at least as great as the combined length of both the lead and the tail end sections. The tail end section has laterally paired locking members separated by neck members along its length. It is easily pulled through the aperture to lock any pair of the locking members against the minimum dimension edges of the aperture and yet is easily and quickly unlocked from the aperture by aligning its locking members with the maximum dimension of the aperture and pulling it free from the aperture. The ideal lock aperture has a Saturn design.

16 Claims, 1 Drawing Sheet

ADJUSTABLE ADVERTISING BAND

BACKGROUND OF THE INVENTION

This invention relates to an adjustable advertising band for quick and easy locking, unlocking, and re-locking on merchandise.

It is well known that the purchasing decisions of consumers are driven not only by price but by quality. Quality involves an assessment of product components (i.e., appearance, look, feel, smell, etc.) as well as an assessment of labeling components (i.e., judgments regarding the product and the producer or sponsor of the product). With increasing competition for the consumer dollar, product differentiation emphasizing both components of quality is essential to increase market share.

This is particularly the case in the marketing of agricultural produce. Fresh-appearing produce sends a message of quality to the customer. But keeping agricultural produce in a fresh and visually appealing state requires more than casual attention. Water sprays and cooling air can help. But from the time produce is first harvested, there is the possibility of spoilage, and this is exacerbated under supermarket open display conditions, especially in the case of leafy agricultural produce. Even in the case of non-leafy produce, there sometimes exists a need to remove some portion that detracts from the sought-after look of quality. And it is at the end of the marketing chain, in the supermarket, where the look of quality is most critical for influencing the purchase decision of the consumer. It is also at that critical moment that judgment on quality is influenced by attention-getting advertising information, including attractive markings, trademarks, designs, recipes for use, nutritional information, and of course, the ubiquitous product and bar codes (whether optical, magnetic, or otherwise)—all of which can prompt the consumer toward a favorable subjective judgment about the produce and the producer or source of it.

Advertising labels sometimes may not be removed from produce when an effort is made to freshen it each day (e.g., as by removing wilted parts), but where removal is required to freshen the appearance of the produce, twist-tied labels are sometimes looked upon as too time-consuming to remove and replace, and adhesive tape labels are generally considered unsatisfactory since they do not readily re-stick or re-attach to cold wet vegetable surfaces. Needless delays in taking off and re-applying advertising labels during the process of freshening agricultural produce in the display racks, as well as the problem of effective advertising label reattachment, can deter or discourage effective freshening steps.

What has been needed is an appropriate advertising label that can be quickly and easily locked about merchandise and then quickly and easily unlocked to freshen the merchandise (such as by removal of damaged or wilted parts), followed by subsequent quick and easy re-locking or reattachment of the advertising label after the merchandise is freshened.

SUMMARY OF THE INVENTION

The invention provides an adjustable advertising band especially designed for convenient display of advertising and additionally designed for quick and easy locking, unlocking and re-locking about merchandise. The band comprises an elongated substantially flat strip of flexible sheet material having a longitudinal axis and having a lead end section, a body section, and a tail end section in sequential alignment along the longitudinal axis.

The lead end section of the strip has lateral sides defining its transverse width and a lock aperture with opposing circularly curved lateral internal edges located entirely within and spaced from the lateral sides of the transverse width. The aperture has a maximum and a minimum dimension. The maximum dimension is substantially in the direction of the longitudinal axis of the strip. The minimum dimension is between the opposing circularly curved lateral internal edges of the aperture and lies in a direction substantially transverse to the longitudinal axis of the strip.

The body section of the strip has a substantial length and a substantial transverse width and has front and back surfaces for displaying advertising information. The length of the body section is at least as great as the combined length of both the lead and the tail end sections. The transverse width of the body section is at least as great as the transverse width of the lead end section. The significant size of the body section permits a maximum impact for advertising on it.

The tail end section of the strip has a length equipped with a plurality of laterally paired locking members separated by neck members along its length. The paired locking members are no greater in transverse width than the transverse width of the lead end section and are less in transverse width than the maximum dimension of the aperture of the lead end section. The neck members are no greater in transverse width than the minimum dimension of the aperture. This tail end section is easily pulled to a varying degree through the aperture to lock any pair of the locking members against the opposing circularly curved lateral internal edges of the aperture and yet easily and quickly unlocked from the aperture by aligning the locking members of it with the maximum dimension of the aperture and pulling the tail end section free from the aperture, to thereby allow subsequent adjusted quick and easy re-locking of the advertising band about merchandise.

The body section of the band should in most instances have a transverse width in excess of about 1 inch throughout its length and a length in excess of 6 inches. An equally wide transverse width in both the body and lead end sections saves against needless waste of material and yet provides for the greatest area of advertising combined with the greatest ease of handling.

Many other features and benefits and advantages of the invention will be evident from the detailed description below.

DESCRIPTION OF THE PREFERRED EMBODIMENT

Figure 1:
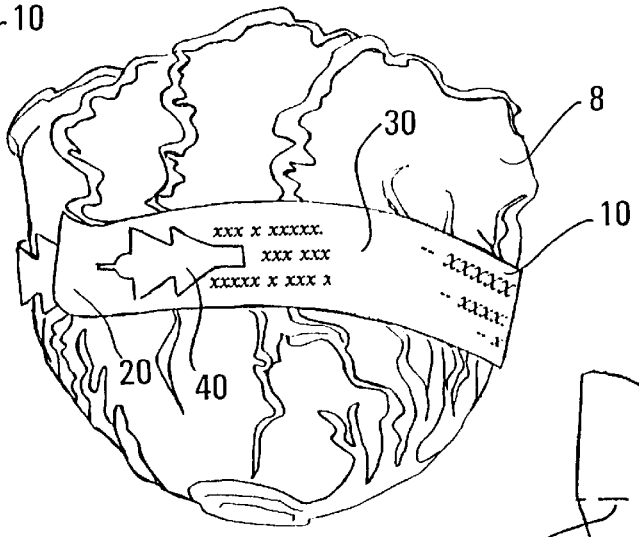
FIG. 1 is a schematic perspective view of the new advertising band of the invention in a locked condition about merchandise such as, for example, a leafy agricultural product.

Referring to the drawing, particularly FIG. 1, merchandise 8 such as agricultural produce (e.g., romaine lettuce)

has an adjustable advertising band 10 wrapped around it. The band is elongated and is in essence a simple substantially flat strip of sheet material. The band has a longitudinal axis 12 (see FIG. 2) extending down the length of the strip, and has three main parts, namely a lead end section 20, a body section 30, and a tail end section 40, all in sequential alignment along the longitudinal axis 12.

Figure 2:
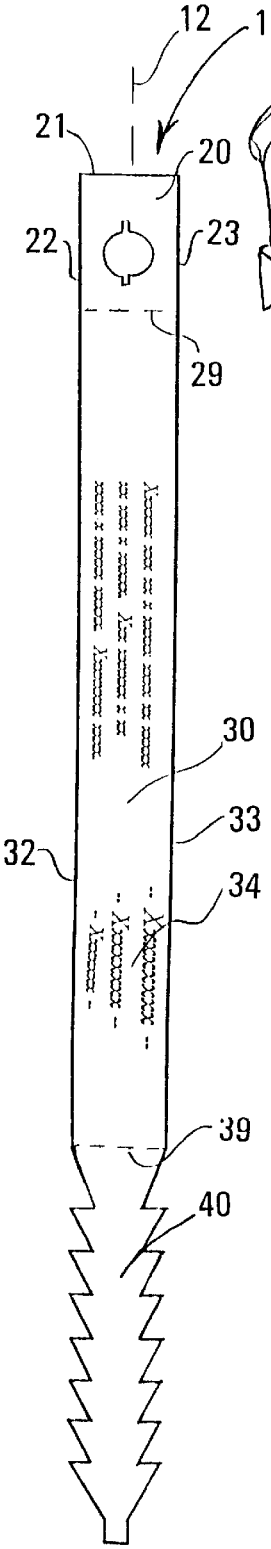
FIG. 2 is a schematic flat planar view of the new advertising band.
Figure 3:
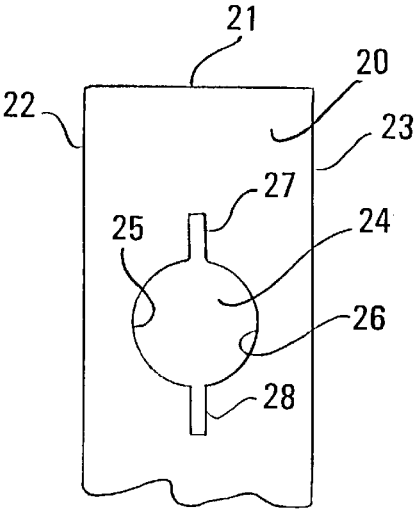
FIG. 3 is an enlarged schematic view of the flat lead end section of the new advertising band and particularly illustrates the locking aperture of that end.
Figure 4:
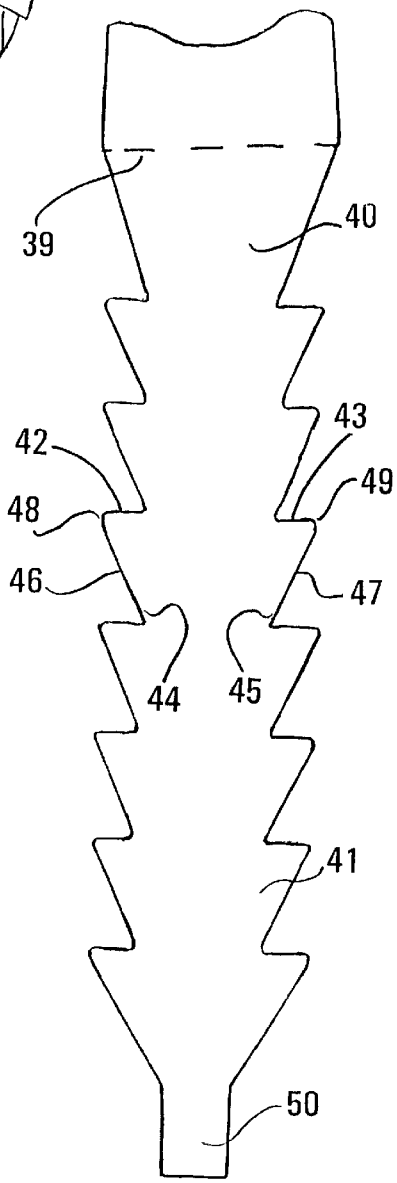
FIG. 4 is an enlarged schematic view of the tail end section of the new advertising band, particularly illustrating the flat tongue that is easily pulled through the locking aperture to lock the band about merchandise and also easily and quickly unlocked from the aperture for the purpose of freshening up vegetables and then adjustably re-locked about the merchandise.

The lead end section has an outer end 21 and has lateral sides 22 and 23 that establish the transverse width of it. A lock aperture 24 (see FIG. 3) is more or less centrally located in the lead end section and is spaced from the outer end 21 of it, as well as spaced from the lateral sides 22, 23 of it. The aperture has opposing circularly curved lateral internal edges 25 and 26 located entirely within and spaced from the lateral sides of the transverse width. There is a maximum and a minimum dimension for the aperture. The maximum dimension is substantially in the direction of the longitudinal axis of the strip and suitably is formed by opposing slots 27 and 28 extending in the axial direction of the strip outwardly from the main body of the aperture 24. This maximum dimension may vary from literal alignment with the longitudinal axis of the strip (e.g., up to about 40 degrees from the axis) but is always substantially in the direction of the longitudinal axis of the strip. The minimum dimension for the aperture is transverse to the longitudinal axis of the strip. Further, the minimum dimension extends between the opposing circularly curved lateral internal edges 25 and 26 of the aperture. The circular curvature of the internal edge 25 and 26 preferably extends in the circular direction at least up to about 45 degrees on each side of a bisecting transverse line through a symmetrical aperture. Put another way, the curved internal edges 25, 26 extend in a circular direction up to about 45 degrees on each side of a direction transverse to the longitudinal axis of the strip. The circular curvature of the internal edges 25, 26 contribute to maintenance of a reliable locked condition for the tail end section even when some rotation of the tail end section with respect to the lead end section might arise during slightly rough consumer handling in a display case. Ideally, the aperture opening has a Saturn shape, namely a circular shape with opposing slots (cf., ring of Saturn) projecting outwardly from the circular shape. The broken line 29 in FIG. 2 illustrates the end of the lead-in section 20 and the beginning of the body section 30.

The body section 30 has left and right lateral edges 32 and 33, which establish the very substantial transverse width of the body section. Further, the body section has a very substantial length between its ends 29 and 39. The length of the body section is at least as great as the combined length of both the lead-in section and the tail section. Both the front and back surfaces of the body section are available for displaying advertising information 34. Herein, "advertising" is used generically to embrace not only trademark or trademarks (including decorative information and slogans), but also any explanatory information dealing with the product or producer or source of the product, plus the common generic name of the product, the PLU number, any bar code (whether optical, magnetic or other readable code), suggestions for preserving the product, nutritional information, recipes, and any other printed information for creating a desired impression on a potential consumer.

Significantly, the transverse width of the body section should be at least as great as the transverse width of the lead-in section, or put another way, the transverse width of the body section throughout its length is most preferably at least as great and may be greater than the widest transverse width of the lead-in section. For maximum avoidance of waste of sheet material during manufacturing, the transverse width of both the body section and the lead-in section should be the same.

The tail end section 40 has a transverse width that suitably varies along its length but, at its maximum, is not greater than the transverse width of the lead end section. In essence, the tail section is more or less a flat tongue. It has a length and is equipped along its length with a multiplicity of laterally paired locking members 42 and 43 in the nature of abutment shoulders having laterally outermost extremities 48 and 49. Between each pair of locking members is a neck, and the neck is defined as the material between opposing notches 44 and 45. Thus the necks separate the paired locking members.

The tail end section will now be explained in greater detail. It has a resemblance to a flat tongue. It is designed to be locked in the aperture of the lead end section and yet is also capable of being easily unlocked from the lead end section and then re-locked in the aperture any number of times. The flat tongue contains or is made up of a sequence of truncated arrowheads 41 pointing away from the lead end section and merging one into the other. It is in this manner that the point of each arrowhead is truncated because it merges into the base of each arrowhead. Each arrowhead has a pair of lateral shoulders 42 and 43 that extend laterally outward at the base or rear part of the arrowhead. The point of the arrowhead is truncated, and it is at the truncated end of the arrowhead that a neck (between notches 44 and 45) is located. The neck merges into the base of the next succeeding arrowhead. Between the neck and the opposing lateral shoulders of the arrowhead are sloping or oblique lateral sides 46 and 47. These lateral sides extend from the laterally outermost extremity 48 and 49 of the opposing paired shoulders to the neck.

Each pair of opposing lateral shoulders 42 and 43 (also called locking members) has a maximum lateral dimension 48 and 49 that is substantially greater than the minimum dimension of the aperture 24 and less than the maximum dimension 27, 28 of the aperture (i.e., less than the dimension of the aperture that extends substantially in the axis direction of the strip or band). A feature of the neck between notches 44, 45 is that it must have a maximum lateral dimension not greater than the minimum dimension of the aperture, so as to allow the neck to rest easily in the aperture (between the circularly curved lateral internal edges 25 and 26) while the opposing lateral shoulders 42 and 43 of an arrowhead are in locked abutment against the opposing circularly curved lateral internal edges of the aperture. The neck may be quite narrow but preferably is not narrower than approximately 70 or 80 percent of the minimum dimension of the aperture. A finger pull or tab 50 at the very end of the tail section may be contoured for easy insertion in and pulling through the aperture 24.

The tail end features permit it (i.e., the flat tongue shape) to be quickly and easily pulled to a varying degree through the aperture in a manner that causes the flexible sheet material of the strip at the lateral opposing internal edges 25 and 26 of the aperture, as well as at the arrowheads 41 of the flat tongue, to each yield (as by slight bending) as the arrowheads are pulled through the aperture. The tongue is pulled through the aperture to a varying degree to lock a single pair of opposing lateral shoulders 48 and 49 in an abutting relationship against the opposing lateral internal edges 25 and 26 of the aperture. Nevertheless, the flat tongue can be quickly and easily unlocked from the aperture simply by aligning the opposing shoulders of the arrowheads of the tongue with the maximum dimension of the aperture and pulling the tongue from the aperture. In this manner, the adjustable advertising band of the invention, after unlocking and removal from merchandise, allows one to freshen or otherwise clean merchandise and then re-lock the band quickly and easily back on the merchandise.

Illustratively, an ideal adjustable advertising band of the invention may have an overall band length of near astonishing proportions. For example, band lengths of 30 inches or so, with body advertising sections as long as 20 in. or more, may be employed, if desired, especially for bulky, leafy vegetables. Generally, however, an over-all band length of approximately 16 in. or no more than about 20 in.—but never less than about 6 in.—will be employed. Realistic band widths, especially for the advertising body section, will rarely if ever be less than ¾ in. (although they could approach but be greater than ½ in.) and generally will be at least about 1 in. up to possibly about 1½ in. or even 2 in. in width. The tail end section should not exceed approximately one-third of the total strip or band length and the lead end section should not exceed about one-sixth of the total length. Thus, an illustrative over-all band of 16 in. in length will have a lead end not in excess of 2 in. in length and a tail end section not in excess of about 5 or 6 in. in length. The bulky elongated body section of flat sheet material for carrying the advertising information, in combination with the quickly and easily lockable, unlockable, and re-lockable features of the invention, are critical.

The relatively large width and length for the bands means that apertures having a minimum dimension of less than ½ in. between their laterally opposed curved interior edges will be rare. Generally, for band widths of 1 in., the aperture employed will have an internal lateral width between circularly curved lateral edges between about ½ in. and about ¾ in. or possibly ⅞ in. The maximum dimension of apertures for bands having a maximum 1-in. lateral width for shoulders 42 and 43 will generally be slightly greater than the maximum width of the shoulders, and suitably may be approximately 1⅛ or even 1⅜ in. or so. This greater maximum dimension for the aperture relative to the maximum width for the shoulders 42 and 43 is necessary to readily accommodate the 1-in. maximum width for the lateral shoulders of the tail end section during unlocking. The main part of the aperture establishing its minimum dimension in the direction substantially transverse to the longitudinal axis has a circular shape that contributes to reliable locking. A slot or slots project from the main aperture and provide the maximum dimension of the aperture; but these slots need not necessarily have parallel side edges. Also, the side edges may even be so close together that the slot has the characteristics of a slit or cut. The orientation of the maximum dimension provided by a slot or slots may vary from perfect alignment along the longitudinal axis of the band or strip. The critical point is that the maximum dimension of the aperture is never even close to being transverse to the longitudinal axis. Any such deviation would cause the advertising band to unlock too easily and fall off the merchandise and thus cause undesired connotations of lack of quality.

The preferred sheet material out of which to cut the new advertising band of the invention is printable and water resistant. Illustratively, a plastic olefin type sheet material under the trademark Teslin from PPG Industries of Pittsburgh, Pa. gives excellent results. The thickness of the sheet material should be such that it is not flimsy but has some body or structural integrity to it and yet is sufficiently flexible to be easily curved and capable of recovery from a curved condition. Such recovery or return from a curved condition can be exceedingly slow. Where a curve is so severe as to form a crease, a useful sheet material for the invention suitably may not recover from the creased condition. In other words, the sheet material for practicing the invention is such that it performs much the same as a sheet of plain photocopy paper having a weight of around 16 to 32 pounds per ream. But the sheet material should not be of cardboard thickness nor exhibit cardboard resistance to bending or flexible yielding. If ordinary paper sheets are employed for the new bands, it is desirable to impart some water resistance to such sheets by spraying or otherwise coating them with a thin plastic layer. Sheets for the invention may be formed from a wide variety of organic plastics. Polyolefins are especially economical and are preferred. Laminations of different materials are useful. Any suitable printing technique may be employed.

Those skilled in the art will readily recognize that this invention may be embodied in still other specific forms than illustrated without departing from the spirit or essential characteristics of it. The illustrated embodiments are therefore to be considered in all respects illustrative and not restrictive, the scope of the invention being indicated by the appended claims rather than the foregoing description, and all variations that come within the meaning and range of equivalency of the claims are therefore intended to be embraced thereby.

That which is claimed is:

1. An adjustable advertising band for quick and easy wrapping and locking, unlocking and re-locking about merchandise, said band consisting of a flexible uniformly thick sheet material in the form of an elongated substantially flat strip having a longitudinal axis and having a lead end section, a body section, and a tail end section in sequential alignment along said longitudinal axis, (i) said lead end section of said strip of sheet material having lateral sides defining its transverse width and a single lock aperture with opposing circularly curved lateral internal edges located entirely within and spaced from the lateral sides of said transverse width, said aperture having a maximum and a minimum dimension, said maximum dimension being substantially in the direction of said longitudinal axis of said strip, said minimum dimension being between said opposing circularly curved lateral internal edges of said aperture and lying in a direction substantially transverse to said longitudinal axis of said strip, said circularly curved lateral internal edges of said aperture being such as to extend in a circular direction up to about 45 degrees on each side of a direction transverse to said longitudinal axis of said strip and connect directly to internal edges that define said maximum dimension, (ii) said body section of said strip of sheet material having a substantial length and a substantial transverse width and having front and back surfaces for displaying advertising information, said length of said body section being at least as great as the combined length of both said lead and said tail end sections, and said transverse width of said body section being at least as great as the transverse width of said lead end section, and (iii) said tail end section of said strip of sheet material having a length equipped with a plurality of laterally paired locking members separated by neck members along said length, said paired locking members being no greater in transverse width than the transverse width of said lead end section and of less transverse width than the maximum dimension of said aperture of said lead end section, said neck members being no greater in transverse width than said minimum dimension of said aperture, said tail end section being easily pulled to a varying degree through said aperture to lock any pair of said locking members against said opposing circularly curved lateral internal edges of said aperture and yet easily and quickly unlocked from said aperture by aligning said locking members of said tail end section with said maximum dimension of said aperture and pulling said tail end section free from said aperture, to thereby allow subsequent adjusted quick and easy re-locking of said advertising band about merchandise.

2. The band of claim 1 wherein the transverse width of said body section is at least about one inch throughout its length.

3. The band of claim 1 wherein said body section has a length in excess of 6 inches and a uniform width throughout its length.

4. The band of claim 1 wherein the transverse width of said body section and the transverse width of said lead end section are substantially identical throughout the length of each.

5. The band of claim 1 wherein said sheet material is printable and water resistant.

6. The band of claim 1 wherein said sheet material comprises plastic.

7. The band of claim 1 wherein said aperture is substantially circular except for its shape in the direction of its maximum dimension.

8. The band of claim 1 wherein said maximum dimension of said aperture does not vary more than about 40 degrees from said longitudinal axis.

9. The band of claim 1 wherein said maximum dimension of said aperture comprises a slot.

10. The band of claim 1 wherein the maximum dimension of said aperture comprises opposing slots.

11. The band of claim 1 wherein the length of said tail end section does not exceed about one third of the total length of said band.

12. The band of claim 1 wherein the length of said lead end section does not exceed about one sixth of the total length of said band.

13. The band of claim 1 wherein said sheet material comprises a polyolefin plastic.

14. A method of attractively band marking merchandise comprising agricultural produce in a manner permitting easy removal of the band marking for freshening the merchandise, comprising the steps of:

i. providing the band of claim 1;

ii. encircling said band about said merchandise;

iii. inserting said tail end section of said band into said aperture of said lead end section of said band;

iv. pulling said tail end section through said aperture until said band snugly embraces said merchandise; and v. lodging any pair of said locking members of said band against said opposing circularly curved lateral internal edges of said aperture of said band so to fixedly secure said band about said merchandise but in a manner permitting said band to be quickly and easily unlocked by rotating said tail end section within said aperture to align said tail end section with the maximum dimension of said aperture for easy removal of said tail end section from said aperture and easy removal of said band from said merchandise to freshen the agricultural produce thereof.

15. An adjustable advertising band for quick and easy wrapping and locking, unlocking and re-locking about merchandise, said band consisting of a flexible uniformly thick sheet material in the form of an elongated substantially flat strip having a longitudinal axis and having a lead end section, a body section, and a tail end section in sequential alignment along said longitudinal axis, (i) said lead end section of said strip of sheet material having lateral sides defining its transverse width and a single lock aperture with opposing circularly curved lateral internal edges located entirely within and spaced from the lateral sides of said transverse width, said aperture having a maximum and a minimum dimension, said maximum dimension being substantially in the direction of said longitudinal axis of said strip, said minimum dimension being between said opposing circularly curved lateral internal edges of said aperture and lying in a direction substantially transverse to said longitudinal axis of said strip, said circularly curved lateral internal edges of said aperture being such as to extend in a circular direction up to about 45 degrees on each side of a direction transverse to said longitudinal axis of said strip and connect directly to internal edges that define said maximum dimension, (ii) said body section of said strip of sheet material having a substantial length and a substantial transverse width and having front and back surfaces for displaying advertising information, said length of said body section being at least as great as the combined length of both said lead and said tail end sections, and said transverse width of said body section being at least as great as the transverse width of said lead end section, and (iii) said tail end section of said strip of sheet material having a maximum transverse width no greater than the transverse width of said lead end section and comprising a flat tongue consisting of a sequence of truncated arrowheads pointing away from said lead end section and merging one into the other, each said arrowhead comprising a pair of opposing lateral shoulders at the base thereof, a neck at the truncated end thereof merging with the base of said next succeeding arrowhead, and a pair of opposing sloping lateral sides extending from the laterally outermost extremity of said opposing shoulders to said neck, each said pair of opposing lateral shoulders having a maximum lateral dimension that is substantially greater than the minimum dimension of said aperture and less than said maximum dimension of said aperture, and each said neck having a maximum lateral dimension not greater than said minimum dimension of said aperture, whereby said flat tongue may be quickly and easily pulled to a varying degree through said aperture to lock a single pair of said opposing lateral shoulders in abutment against said opposing circularly curved lateral internal edges of said aperture and yet can be quickly and easily unlocked from said aperture by aligning said opposing shoulders of said arrowheads with said maximum dimension of said aperture and pulling said tongue free from said aperture, to thereby allow subsequent adjusted quick and easy re-locking of said advertising band about merchandise.

16. As a new article of manufacture: agricultural produce having an advertising band thereabout, said band consisting of a flexible uniformly thick sheet material in the form of an elongated substantially flat strip having a longitudinal axis and having a lead end section, a body section, and a tail end section in sequential alignment along said longitudinal axis, (i) said lead end section of said strip of sheet material having lateral sides defining its transverse width and a single lock aperture with opposing circularly curved lateral internal edges located entirely within and spaced from the lateral sides of said transverse width, said aperture having a maximum and a minimum dimension, said maximum dimension being substantially in the direction of said longitudinal axis of said strip, said minimum dimension being between said opposing circularly curved lateral internal edges of said aperture and lying in a direction substantially transverse to said longitudinal axis of said strip, said circularly curved lateral internal edges of said aperture being such as to extend in a circular direction up to about 45 degrees on each side of a direction transverse to said longitudinal axis of said strip and connect directly to internal edges that define said maximum dimension, (ii) said body section of said strip of sheet material having a substantial length and a substantial transverse width and having front and back surfaces for displaying advertising information, said length of said body section being at least as great as the combined length of both said lead and said tail end sections, and said transverse width of said body section being of uniform dimension throughout said length of said body section and at least as great as the transverse width of said lead end section, and (iii) said tail end section of said strip of sheet material having a length equipped with a plurality of laterally paired locking members separated by neck members along said length, said paired locking members being no greater in transverse width than the transverse width of said lead end section and of less transverse width than the maximum dimension of said aperture of said lead end section, said neck members being no greater in transverse width than said minimum dimension of said aperture, said tail end section being pulled through said aperture to lock any pair of said locking members against said opposing circularly curved lateral internal edges of said aperture and yet permit easy and quick unlocking of said tail end section from said aperture by aligning said locking members of said tail end section with said maximum dimension of said aperture and pulling said tail end section free from said aperture, to thereby allow freshening of said agricultural produce and subsequent adjusted quick and easy re-banding of said advertising band about said agricultural produce.

* * * * *